US009011571B2

(12) United States Patent
Fredriksson et al.

(10) Patent No.: US 9,011,571 B2
(45) Date of Patent: Apr. 21, 2015

(54) METHOD, ARRANGEMENT AND PELLETISING PLANT

(75) Inventors: Christian Fredriksson, Luleå (SE); Stefan Savonen, Svappavaara (SE)

(73) Assignee: Luossavaara-Kiirunavaara AB, Luleå (SE)

( * ) Notice: Subject to any disclaimer, the term of this patent is extended or adjusted under 35 U.S.C. 154(b) by 118 days.

(21) Appl. No.: 13/881,697

(22) PCT Filed: Oct. 26, 2011

(86) PCT No.: PCT/SE2011/051275

§ 371 (c)(1), (2), (4) Date: Apr. 25, 2013

(87) PCT Pub. No.: WO2012/057687

PCT Pub. Date: May 3, 2012

(65) Prior Publication Data

US 2013/0220075 A1 Aug. 29, 2013

(30) Foreign Application Priority Data

Oct. 26, 2010 (SE) ..... 1051112

(51) Int. Cl.
*C22B 1/02* (2006.01)
*C22B 1/20* (2006.01)
(Continued)

(52) U.S. Cl.
CPC . *C22B 1/02* (2013.01); *C22B 1/205* (2013.01); *C22B 1/212* (2013.01); *F27B 9/3005* (2013.01); *F27B 9/36* (2013.01); *F27B 21/00* (2013.01)

(58) Field of Classification Search
CPC ..... C22B 1/205; C22B 1/212; C22B 1/02; F27B 9/36; F27B 9/3005; F27B 21/00
USPC ..... 75/769; 266/171, 175, 176
See application file for complete search history.

(56) References Cited

U.S. PATENT DOCUMENTS 3,782,888 A 1/1974 Cnare
3,947,001 A 3/1976 Leighton
(Continued)

FOREIGN PATENT DOCUMENTS

EP 79264 B * 3/1986
GB 746841 A 3/1956
(Continued)

OTHER PUBLICATIONS

Machine translation of EP 79264 published Mar. 1986.*
(Continued)

*Primary Examiner* — George Wyszomierski
*Assistant Examiner* — Tima M McGuthry Banks
(74) *Attorney, Agent, or Firm* — Morrison & Foerster LLP

(57) ABSTRACT

A method for the oxidation and sintering of pellets includes the introduction of a first medium into a compartment through an inlet connected to the compartment and the heating of the medium in the inlet through the use of a combustion arrangement. The use of the combustion arrangement includes the ignition of the fuel, the combustion of the fuel, and the transfer of combustion heat to the first medium that is present at the combustion arrangement. In a region in the inlet outside the direct passage of the first medium, the ignition of the fuel, the combustion of the fuel and the transfer of combustion heat to the first medium take place. By the introduction of a second medium into the region in the direct vicinity of the combustion arrangement, the combustion of the fuel and the transfer of combustion heat also to the second medium take place.

15 Claims, 4 Drawing Sheets

(51) Int. Cl.

| | |
|---|---|
| ***C22B 1/212*** | (2006.01) |
| ***F27B 9/30*** | (2006.01) |
| ***F27B 9/36*** | (2006.01) |
| ***F27B 21/00*** | (2006.01) |

(56) References Cited

U.S. PATENT DOCUMENTS

| | | | |
|---|---|---|---|
| 6,338,366 | B1 | 1/2002 | Williams |
| 2001/0032527 | A1 | 10/2001 | Fujioka et al. |

FOREIGN PATENT DOCUMENTS

| | | | |
|---|---|---|---|
| JP | 11-325740 | A | 11/1999 |
| JP | 2010-163656 | A | 7/2010 |

OTHER PUBLICATIONS

International Search Report and Written Opinion received for PCT Patent Application No. PCT/SE2011/051275, mailed on Feb. 14, 2012, 9 pages.

International Preliminary Report on Patentability received for PCT Patent Application No. PCT/SE2011/051275, mailed on May 10, 2013, 6 pages.

Non-Final Office Action received for U.S. Appl. No. 13/881,713, mailed on Jan. 13, 2015, 11 pages.

International Search Report and Written Opinion received for PCT Patent Application No. PCT/SE2011/051273, mailed on Feb. 14, 2012, 9 pages.

* cited by examiner

METHOD, ARRANGEMENT AND PELLETISING PLANT

CROSS REFERENCE TO RELATED APPLICATIONS

This is a U.S. National Phase patent application of PCT/SE2011/051275, filed Oct. 26, 2011, which claims priority to the Swedish Patent Application No. 1051112-9, filed Oct. 26, 2010, each of which is hereby incorporated by reference in the present disclosure in its entirety.

TECHNICAL AREA

This invention concerns a method and an arrangement for the oxidation and sintering of pellets arranged in a compartment with the aid of a medium having high temperature. The invention concerns also a pelletising plant comprising such an arrangement.

BACKGROUND

Iron ore concentrate, finely divided iron ore in powder form, from which undesired components of the ore have been removed, is mixed with water in a preparation plant in order subsequently to be processed in a pelletising plant.

The ore concentrate is dewatered in the pelletising plant and mixed with various additives and binding agents, and rolled to pellets. The pellets are dried in a drying arrangement and heated in a compartment such that the pellets are oxidised and sintered, caused to melt together, one by one, to form final pellets, which maintain their shape during further transport. A cooling of the pellets subsequently takes pace in a cooling arrangement. The pellets are now ready and can be transported onwards to the locations at which the ore is to be further refined.

The use of an arrangement comprising an inlet connected to the compartment for introduction of a medium through the inlet and into the compartment is previously known. A combustion arrangement for heating the medium is arranged in the inlet. The combustion arrangement comprises fuel that, when the arrangement is in use, is ignited and combusted. Combustion heat is developed during the combustion of the fuel, which heat is transferred to the medium that is present at the combustion arrangement in the inlet and that passes through the inlet on its way to the compartment.

The heating of the pellets in a compartment is a very critical step in the processing of the pellets and requires a relatively high temperature in order to obtain a good result, in order for the pellets to be durable. There is a desire to secure, or even to increase, the heat of the medium in order to improve the sintering.

The heating, the sintering, the oxidation, of the pellets results in conversion of magnetite to haematite, having NOx as a waste product. NOx becomes present in the medium, which has, after the sintering, completed its task and is to be replaced by new, hot medium. NOx is harmful to the environment and it is therefore desirable that the sintering give rise to as little NOx as possible.

The introduction of cold air that is heated in order to be used as the hot medium gives a good reduction in NOx level, but brings with it the result that the energy consumption becomes high.

DESCRIPTION OF THE INVENTION

One purpose of this invention is to offer a method, an arrangement and a pelletising plant that ensures that a low NOx level is obtained during the oxidation and sintering of pellets arranged in a compartment, while at the same time reduced energy consumption is achieved.

This is obtained with a method having the technical features that are described in claim 1, an arrangement with the technical features that are described in claim 9 and a pelletising plant according to claim 21.

Preferred embodiments of the invention will be described below with reference to the drawings.

DETAILED DESCRIPTION OF EMBODIMENTS

Figure 1:
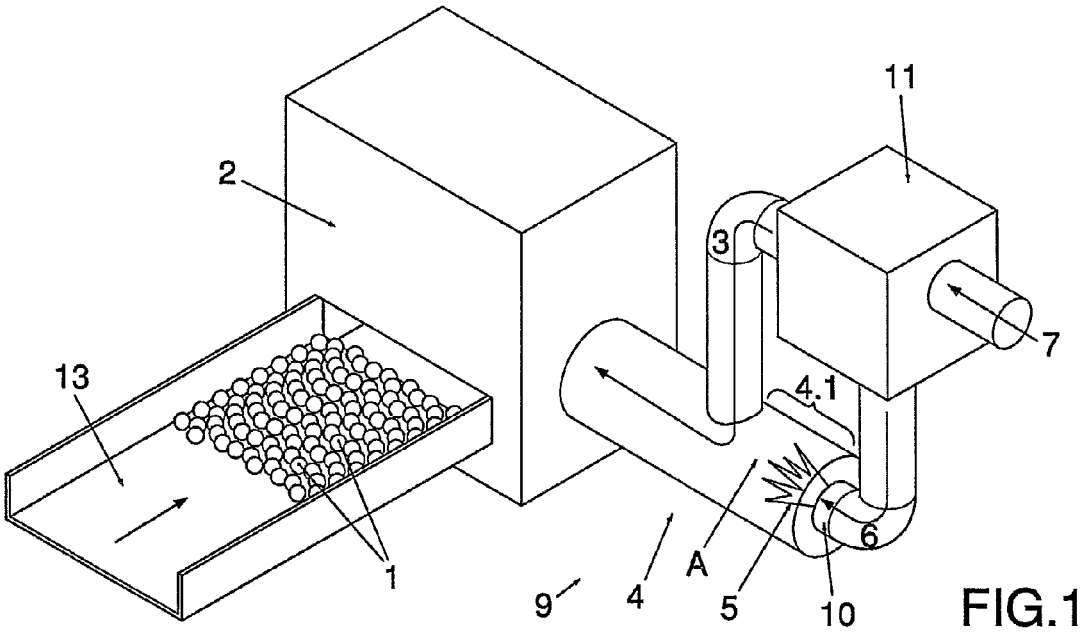
FIG. 1 shows an arrangement according to the invention.

A method and an arrangement according to this invention that will be described below will have the same function and intention independently of whether it is a pelletising plant with iron pellets of whether it is a more general sintering plant in which ore concentrate is not formed into pellets but where the ore concentrate is oxidised and sintered without first being formed. The term "pelletising plant" in the description below is to be interpreted in its widest sense, which means that also a sintering plant is described by the term. The term "pellets" is also to be interpreted in its widest sense, such that also iron ore concentrate in random aggregates in a sintering plant is described by the term "pellets".

This invention concerns a method for obtaining a low NOx level during the oxidation and sintering of pellets 1 arranged in a compartment 2 in which the sintering takes place with the aid of a medium with a defined temperature, which medium heats the pellets 1.

The method comprises the introduction of a first medium 3 into the compartment 2 through an inlet 4 connected to the compartment 2 and the heating of the first medium 3 in the inlet 4 through the use of a combustion arrangement 5, or a part of a combustion arrangement, arranged in the inlet 4 and comprising fuel. The use of the combustion arrangement 5 comprises the ignition of the fuel, the combustion of the fuel whereby combustion heat is developed, and the transfer of the combustion heat to the first medium 3 that is present at the combustion arrangement 5.

The method comprises further the arrangement of the combustion arrangement 5, or a part of it, in a region A in the inlet 4, which in turn is arranged outside of the direct passage of the first medium in and through the inlet 4, such that the ignition of the fuel, the combustion of the fuel and the transfer of combustion heat to the first medium 3 occur in this region A.

Figure 2:
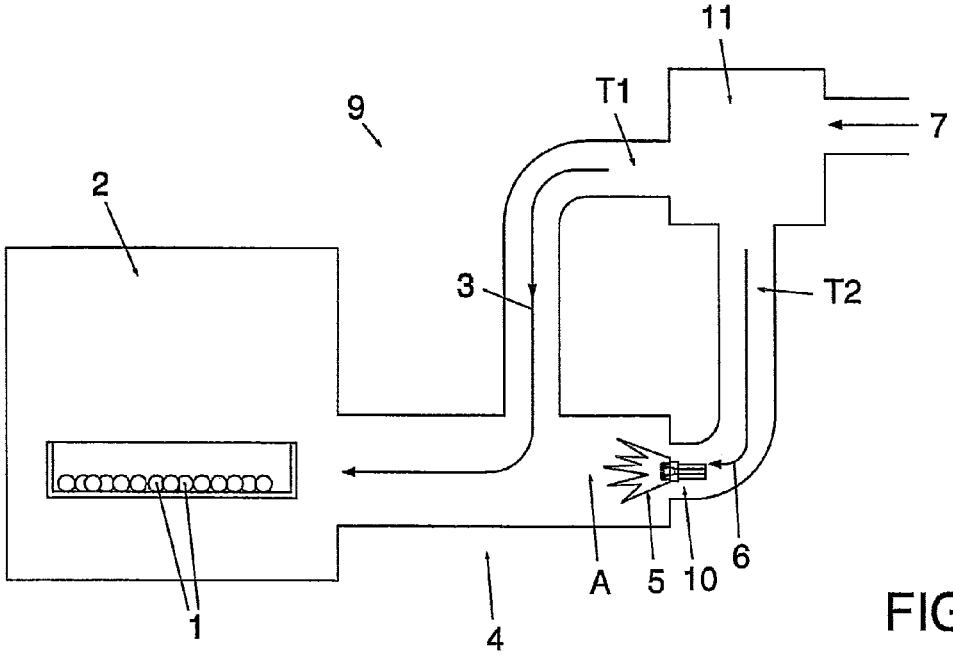
FIG. 2 shows a section through the arrangement in FIG. 1.

The method comprises also the introduction of a second medium 6 into the region A in the direct vicinity of the combustion arrangement 5, or a part of it, where the ignition of the fuel, the combustion of the fuel and the transfer of combustion heat also to the second medium 6 take place. Transport of the heated first medium 3 and the heated second medium 6 through the inlet 4 and into the compartment 2 subsequently takes place. See FIGS. 1 and 2.

Mixing of the heated first medium 3 and the heated second medium 6 takes place before or at the introduction of the two media 3 and 6 into the compartment 2, in order there to oxidise and sinter the pellets 1 that are present in the compartment 2. See FIGS. 1 and 2.

The arrangement of the combustion arrangement 5, or at least a part of it, in the relatively undisturbed region A in the inlet 4 but outside of the direct passage of the first medium in the inlet means that the ignition and combustion of the fuel take place in a region that is not directly influenced, disturbed, by the medium, the first medium 3 that passes in the inlet 4 on its way towards the compartment 2 in which the pellets 1 are located.

The combination of this arrangement of the combustion arrangement 5 in a region A that is not in the direct passage of the first medium with the introduction of two media 3 and 6 at different locations in the inlet 4 gives as a result the assurance that a low NOx level can be achieved during the oxidation and sintering of pellets arranged in a compartment.

When the combustion arrangement 5 is arranged outside of the direct passage of the first medium in the inlet 4, the combustion of the fuel takes place with a lower volume of air than that which has been used previously. The temperature of the first medium will be somewhat lower than previously when the combustion arrangement was located directly in the inlet 4 and in the direct pathway of the medium. This results in a lower flame temperature.

The introduction of the two media 3 and 6 into the inlet 4, one medium of which, the first medium 3, is introduced directly into the inlet 4 and the other medium of which, the second medium 6, is introduced in the direct vicinity of the combustion arrangement 5 makes it possible to increase the temperature of the second medium 6 and to control the parameters inside the compartment 2, with respect to, among other parameters, the heat and the transfer of heat. The supply of the second medium 6 makes it possible to optimise the prevalent combustion conditions with respect to a low NOx level.

The use of a cold medium gives the best reduction in NOx level, but it requires a great deal of energy during the heating of the medium, which takes place with the aid of the combustion arrangement. Quite simply, a large quantity of combustion agent is consumed. It is, therefore, of better cost-effectiveness to preheat the first medium 3 before it is introduced into the inlet 4 or to preheat the second medium 6 before it is introduced in the vicinity of the combustion arrangement 5 in the inlet 4, or to preheat both the first medium and the second medium.

It is appropriate that the first medium 3 and the second medium 6 are preheated to different temperatures T1 and T2, where the first medium 3 is heated to a temperature T1 that is higher than the temperature T2 of the second medium. The temperature T1 of the first medium should lie in the interval 500-1500° C. See FIG. 2.

The supply of two media with different temperatures in this way ensures that the medium that is finally present in the compartment 2 and that constitutes a mixture of the first medium 3, which has been heated by the combustion arrangement 5, and the heated second medium 6 acquires a desired temperature with a suitable level of oxygen, while at the same time that NOx level and the supply of energy can be reduced.

Figure 3:
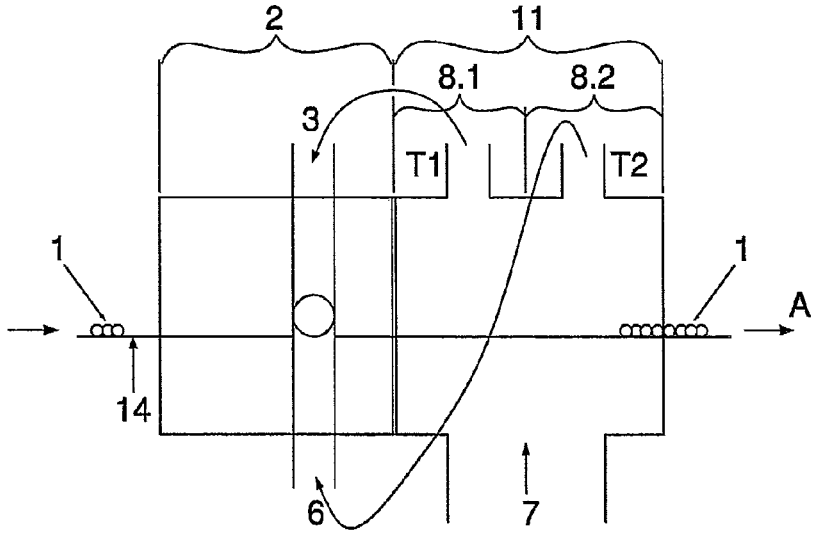
FIG. 3 shows a second embodiment of an arrangement according to the invention.
Figure 4:
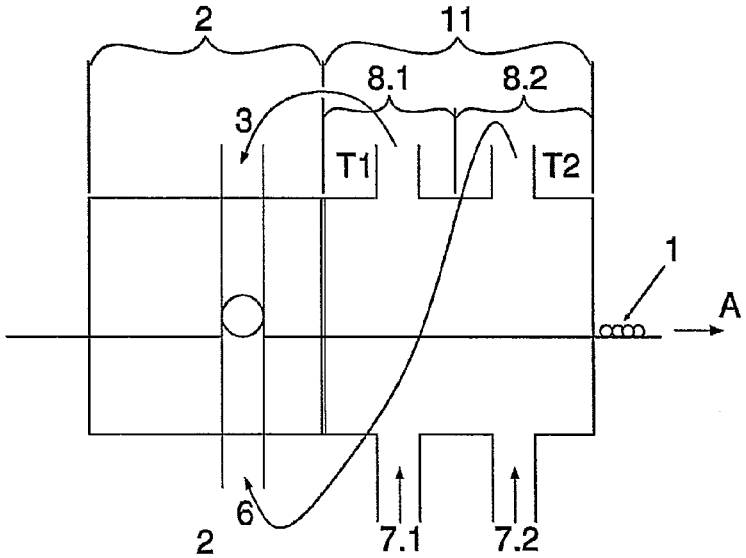
FIG. 4 shows a further embodiment of an arrangement according to the invention.
Figure 5:
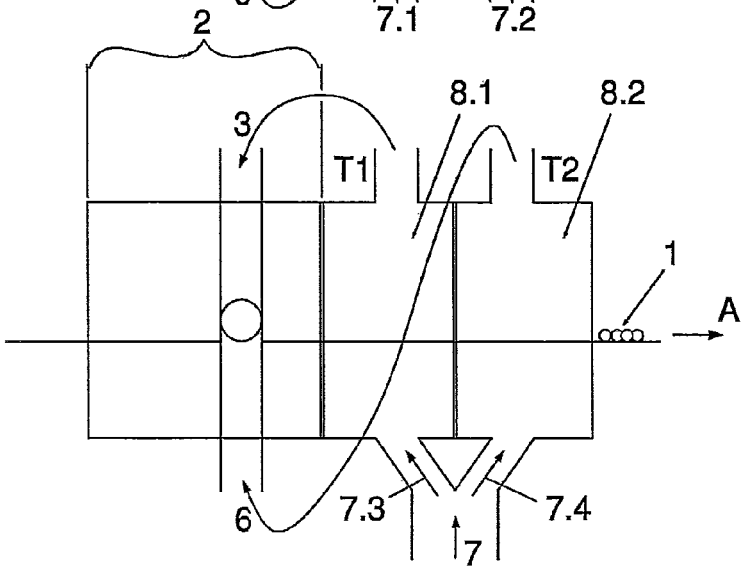
FIG. 5 shows also a further embodiment of an arrangement according to the invention.

The method according to this invention comprises the use of a cooling agent 7 for cooling the heated sintered pellets 1 after the oxidation and the sintering, followed by the use of the heated cooling agent 7 as at least one of the preheated first medium 3 and the preheated second medium 6. See FIGS. 3-5.

Through the recycling of a medium that has acquired heat in another part of the process of manufacturing pellets, through the supply of this heated medium to a heating stage in another part of the process of manufacturing pellets in which a hot medium is needed, the energy that is supplied to the medium is retained in the process and is recycled, such that the supply of further energy in order to heat the medium that is to be heated in order to function in the process can be reduced. This results in a cost-effective manufacturing process that can even so offer low levels of NOx.

The method comprises the division of the cooling agent 7 in the preheated first medium 3 and the preheated second medium 6 after the cooling of the heated sintered pellets 1.

The method may, as an alternative to this, comprise the use of two cooling agents 7.1 and 7.2 that, after cooling of the pellets 1, are used as the preheated first medium 3 and the preheated second medium 6.

A further alternative is that the method comprise the use of a cooling agent 7 and the division of the cooling agent into a first cooling agent fraction 7.3 and a second cooling agent fraction 7.4 before the cooling of the hot, sintered pellets 1, where the first cooling agent fraction 7.3 and the second cooling agent fraction 7.4 are used, after the cooling of the pellets 1, as the preheated first medium 3 and the second medium 6.

The method around the heating of the cooling agent 7 and thus at the same time the preheating of the medium that is used for the heating of the pellets 1 in the compartment 2 at an earlier stage of the manufacturing process comprises the heating of the cooling agent, the cooling agents, the cooling agent fractions 7 and 7.1-7.4 to two different temperatures T1 and T2, which results in a preheated first medium 3 and a preheated second medium 6 with different temperatures T1 and T2.

The method comprises further the use of the cooling agent, the cooling agents, the cooling agent fractions 7 and 7.1-7.4 for the cooling of pellets 1 that are located in at least two different zones 8.1 and 8.2 after their outwards passage from the compartment, where the pellets 1 in the relevant zone 8.1 and 8.2 have different temperatures T1 and T2, which results in a heating of the cooling agent, the cooling agents, the cooling agent fractions 7 and 7.1-7.4 to different temperatures T1 and T2 and thereby the acquisition of different temperatures T1 and T2 by the preheated first medium 3 and the preheated second medium 6.

The two different zones 8.1 and 8.2 follow one after the other such that the pellets 1 that are present in a first zone 8.1 come directly from the compartment 2 and are hotter than the pellets 1 that are present in a second zone 8.2 that follows the first zone 8.1 since the pellets 1 in the first zone 8.1 are cooled with the aid of the cooling agent 7 that passes the first zone 8.1 and is subsequently transported into the second zone 8.2 with a lower temperature than in the first zone 8.1, in order to be further cooled in the second zone 8.2.

It is appropriate that air be used as media 3, 6 and 7 during this method.

This invention concerns also an arrangement 9 that is intended to be used during the oxidation and sintering of pellets 1. This arrangement 9 makes it possible to carry out the method that has been described above.

This arrangement 9 comprises a compartment 2 in which the pellets 1 are arranged and in which a medium with a determined temperature is introduced for the transfer of heat to the pellets 1. The arrangement 9 comprises an inlet 4 connected to the compartment 2 for the introduction of a first medium 3 through the inlet 4 and into the compartment 2 and there heating of the first medium 3.

A combustion arrangement 5, or part of a combustion arrangement, is arranged in the inlet 4 for heating of the first medium 3 in the inlet 4. The combustion arrangement 5 comprises fuel that, during the use of the arrangement 9, is ignited and combusted whereby combustion heat is developed and transferred to the first medium 3 that is located at the combustion arrangement 5.

The inlet 4 comprises a region A, arranged outside of the direct passage of the medium in and through the inlet 4, in which the combustion arrangement 5, or a part of it, is arranged such that the ignition of the fuel, the combustion of the fuel and the transfer of combustion heat to the first medium 3 occur in this region A.

An intake 10 is arranged in connection with the inlet 4 for the introduction of a second medium 6 in the direct vicinity of the combustion arrangement 5, or a part of it, in the region A where the ignition of the fuel and its combustion take place, and also where combustion heat is transferred to the second medium 6. The inlet 4 makes possible the onwards transport of the heated first medium 3 and the heated second medium 6 through the inlet 4 and into the compartment 2. The two heated media are mixed before or at their introduction into the compartment 2.

The inlet 4 comprises an extension 4.1 that originates at a protruding part of the inlet 4, the interior of which offers the region A.

Figure 6:
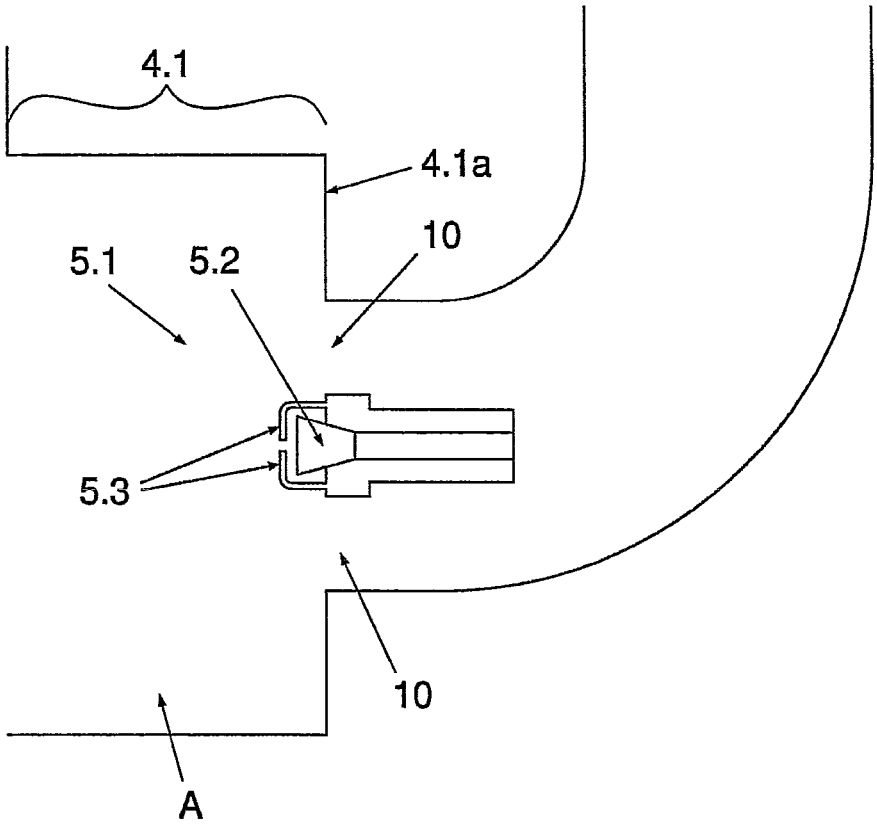
FIG. 6 shows a part of the combustion arrangement.

The combustion arrangement 5, or at least a part of it, is arranged at the innermost side 4.1*a* of the extension, facing principally away from the connection of the inlet with the compartment 2. See FIG. 6.

Also the intake 10 for the second medium 6 is arranged at the innermost side 4.1*a* of the extension, facing principally away from the connection of the inlet with the compartment 2. The intake 10 is arranged in the vicinity of the combustion arrangement 5 such that the direction of transport of the second medium coincides with the direction of the combustion flame into the extension 4.1 of the inlet. See FIG. 6.

The combustion arrangement 5 comprises a component 5.1 that in turn comprises a nozzle 5.2 through which fuel is fed out into the combustion arrangement 5. The combustion arrangement 5 may comprise also an ignition arrangement 5.3 that ignites the fuel. This is normally not needed since the fuel is ignited due to the high temperature that is already present in the inlet 4. The component 5.1 constitutes the part of the combustion arrangement 5 that is arranged in the inlet 4, in the region A. See FIG. 6.

The arrangement 9 comprises a preheating arrangement 11 that heats the first medium 3 before it is introduced into the inlet 4 and the second medium 6 before it is introduced into the inlet 4, the region A, the first medium 3 and the second medium 6 to different temperatures T1 and T2. The preheating arrangement 11 is to preheat the first medium 3 to a temperature T1 that is higher than that of the second medium 6. The first medium 3 is to be preheated to a temperature T1 in the interval 500-1500° C.

The preheating arrangement 11 comprises at least one zone 8.1 or 8.2 through which sintered pellets 1 pass after they have left the compartment 2 and where the zone 8.1 or 8.2 is supplied with a cooling agent 7 or 7.1-7.4 for the cooling of the pellets 1 and where the cooling agent 7 or 7.1-7.4 is thereby heated by the pellets 1 in order subsequently to be used as the preheated first medium 3 and the preheated second medium 6.

It is appropriate that the preheating arrangement 11 comprise at least two zones 8.1 and 8.2 where each one of the zones is supplied with a cooling agent 7 or 7.1-7.4 for the cooling of the pellets 1 in the relevant zone 8.1 and 8.2 and where the cooling agent 7 or 7.1-7.4 thereby is heated by the pellets 1 in the relevant zone 8.1 and 8.2 in order subsequently to be used as the preheated first medium 3 and the preheated second medium 6.

The zones 8.1 and 8.2 are arranged one after the other. The pellets 1 in a first zone 8.1 are hotter than the pellets 1 in a second zone 8.2. Each one of the zones 8.1 and 8.2 is supplied with a cooling agent 7 or 7.1-7.4 for the cooling of the pellets 1 and where the relevant cooling agent 7 or 7.1-7.4 is heated by the pellets 1 to two different temperatures T1 and T2 in order subsequently to be used as the preheated first medium 3 and the preheated second medium 6. The first zone 8.1 is arranged directly after the compartment 2.

Figure 7:
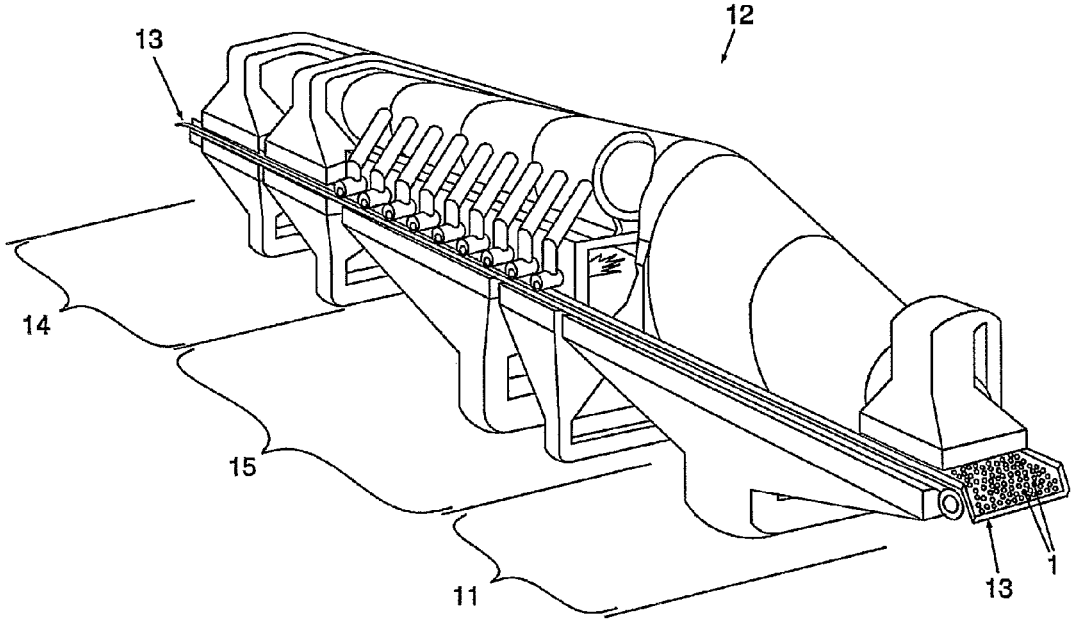
FIG. 7 shows a pelletising plant according to the invention.

The invention concerns also a pelletising plant 12 comprising at least one arrangement 9 according to the description above. For a complete pelletising plant, a number of arrangements 9 are required, comprising inlets 4 and combustion arrangements 5 arranged one after the other along the transport pathway of the pellets through the compartment 2 in which oxidation and sintering take place. The preheating arrangement 11 constitutes at the same time a cooling arrangement in which the pellets 1 are cooled after the oxidation and sintering in the compartment 2. See FIG. 7.

The pelletising plant 12 is of the "straight grate plant" type, and comprises a belt transporter 13 on which pellets 1 are transported through the complete pelletising plant 12, a drying arrangement 14 in which the pellets 1 are dried and may optionally be preheated, an oxidation and sintering part 15 that comprises the compartment 2, and a cooling arrangement/preheating arrangement 11 that follows this sintering part.

This description of different embodiments of the invention and alternative designs of its items and methods is not to be seen as a limitation of the invention: it is to be interpreted in its broadest meaning in order not to limit unnecessarily the protective scope according to the attached patent claims. Changes that lie within the expertise of a person skilled in the arts lie within the protective scope of the innovative concept. The various designs of items that are given in the description above can be used and combined freely, as long as the desired function is obtained.

The invention claimed is:

1. A method for oxidation and sintering of pellets arranged in a compartment in which oxidation and sintering take place with a medium with a determined temperature that heats the pellets, the method comprising:

introducing a first medium into the compartment through an inlet connected to the compartment;

heating the first medium in the inlet through use of a combustion arrangement, or a part of a combustion arrangement, arranged in the inlet, wherein the combustion arrangement or part thereof comprises fuel, where the use of the combustion arrangement or part thereof comprises ignition of the fuel, a combustion of the fuel whereby combustion heat is developed, and a transfer of the combustion heat to the first medium that is present at the combustion arrangement or part thereof;

wherein the combustion arrangement, or a part of it, is in a region in the inlet that in turn is arranged outside of a direct passage of the first medium in and through the inlet such that the ignition of the fuel, the combustion of the fuel and the transfer of combustion heat to the first medium all take place in this region;

introducing a second medium into the region in a direct vicinity of the combustion arrangement, or a part of it, where the ignition of the fuel, the combustion of the fuel and the transfer of combustion heat also to the second medium take place followed by further transport of the heated first medium and the heated second medium through the inlet and into the compartment; and preheating the first medium before it is introduced into the inlet and preheating the second medium before it is introduced in the vicinity of the combustion arrangement in the inlet, wherein the first medium and the second medium are preheated to different temperatures.

2. The method according to claim 1, comprising preheating of the first medium to a temperature that is higher than the temperature of the second medium.

3. The method according to claim 1, comprising preheating of the first medium to a temperature in a range of 500-1500° C.

4. The method according to claim 1, comprising the use of air as the first and/or second medium.

5. A method, oxidation and sintering of pellets arranged in a compartment in which oxidation and sintering take place with a medium with a determined temperature that heats the pellets, the method comprising:

introducing a first medium into the compartment through an inlet connected to the compartment;

heating the first medium in the inlet through use of a combustion arrangement, or a part of a combustion arrangement, arranged in the inlet, wherein the combustion arrangement or part thereof comprises fuel, where the use of the combustion arrangement or part thereof comprises an ignition of the fuel, a combustion of the fuel whereby combustion heat is developed, and a transfer of the combustion heat to the first medium that is present at the combustion arrangement or part thereof;

wherein the combustion arrangement, or a part of it, is in a region in the inlet that in turn is arranged outside of a direct passage of the first medium in and through the inlet such that the ignition of the fuel, the combustion of the fuel and the transfer of combustion heat to the first medium all take place in this region;

introducing a second medium into the region in a direct vicinity of the combustion arrangement, or a part of it, where the ignition of the fuel, the combustion of the fuel and the transfer of combustion heat also to the second medium take place followed by further transport of the heated first medium and the heated second medium through the inlet and into the compartment; and using a cooling agent for cooling heated sintered pellets after oxidation and sintering, followed by using the heated cooling agent as at least one of a preheated first medium and a preheated second medium, wherein the cooling agent is used to cool pellets that are located in at least two different zones where the pellets within the different zones have different temperatures, which results in a heating of the cooling agent to different temperatures depending on which zone has been passed, and thereby providing different temperatures of the preheated first medium and the preheated second medium.

6. An arrangement for the oxidation and sintering of pellets comprising:

a compartment in which the pellets are arranged and in which a first medium with a definite temperature is introduced for a transfer of heat to the pellets;

an inlet connected to the compartment for an introduction of the first medium through the inlet and into the compartment and where heating of the first medium takes place;

a combustion arrangement, or part of a combustion arrangement, arranged in the inlet for the heating of the first medium in the inlet, where the combustion arrangement or part thereof comprises fuel that, during the use of the arrangement, is ignited and combusted whereby combustion heat is developed and transferred to the first medium that is present at the combustion arrangement;

a region of the inlet arranged outside of a direct passage of the first medium in and through the inlet, in which the combustion arrangement, or a part of it, is arranged such that the ignition of the fuel, the combustion of the fuel and the transfer of combustion heat to the first medium take place in this region;

an intake arranged in connection with the inlet for introduction of a second medium in a direct vicinity of the combustion arrangement, or a part of it, in a region at which ignition of the fuel and the combustion take place and also where the combustion heat is transferred to the second medium, and the inlet makes possible a further transport of the heated first medium and the heated second medium through the inlet and into the compartment;

a preheating arrangement that heats at least one of the first medium before it is introduced into the inlet and the second medium before it is introduced into the region of the inlet arranged outside of the direct passage of the first medium;

wherein the preheating arrangement comprises at least two zones, through which the sintered pellets pass, and where each one of the zones is supplied with a cooling agent for the cooling of the pellets in a corresponding zone and where the cooling agent is thereby heated by the pellets in the corresponding zone so as to subsequently be used as a preheated first medium and ae preheated second medium, and the zones are arranged one after another, and the pellets in a first zone are hotter than the pellets in a second zone, and the cooling agent is heated by the pellets to two different temperatures.

7. The arrangement according to claim 6, where the inlet comprises an extension that originates at a protruding part of the inlet, an interior of which offers the region of the inlet arranged outside of the direct passage of the first medium.

8. The arrangement according to claim 7, where the combustion arrangement, or at least a part of it, is arranged at an innermost side of the extension, facing principally away from the connection of the inlet with the compartment.

9. The arrangement according to claim 7, where the intake is arranged at the innermost side of the extension, facing principally away from the connection of the inlet with the compartment.

10. The arrangement according to claim 6, where the first zone is arranged immediately after the compartment.

11. A pelletizing plant comprising an arrangement according to claim 6.

12. The pelletizing plant according to claim 11 of a straight grate plant, comprising a belt transporter on which the pellets are transported through the pelletizing plant, a drying arrangement in which the pellets are dried and may optionally be preheated, an oxidation and sintering part that comprises the compartment and finally a cooling arrangement/preheating arrangement.

13. An arrangement for the oxidation and sintering of pellets comprising:

a compartment in which the pellets are arranged and in which a first medium with a definite temperature is introduced for a transfer of heat to the pellets;

an inlet connected to the compartment for an introduction of the first medium through the inlet and into the compartment and where heating of the first medium takes place;

a combustion arrangement, or part of a combustion arrangement, arranged in the inlet for the heating of the first medium in the inlet, where the combustion arrangement or part thereof comprises fuel that, during the use of the arrangement, is ignited and combusted whereby combustion heat is developed and transferred to the first medium that is present at the combustion arrangement;

a region of the inlet arranged outside of a direct passage of the first medium in and through the inlet, in which the combustion arrangement, or a part of it, is arranged such that the ignition of the fuel, the combustion of the fuel and the transfer of combustion heat to the first medium take place in this region;

an intake arranged in connection with the inlet for introduction of a second medium in a direct vicinity of the combustion arrangement, or a part of it, in a region at which ignition of the fuel and the combustion take place and also where the combustion heat is transferred to the second medium, and the inlet makes possible a further transport of the heated first medium and the heated second medium through the inlet and into the compartment; and a preheating arrangement that heats at least one of the first medium before it is introduced into the inlet and the second medium before it is introduced into the region of the inlet arranged outside of the direct passage of the first medium, wherein the preheating arrangement preheats the first medium and the second medium to different temperatures.

14. The arrangement according to claim 13, where the preheating arrangement preheats the first medium to a higher temperature than that of the second medium.

15. The arrangement according to claim 14, where the preheating arrangement preheats the first medium to a temperature in the interval 500-1500° C.

* * * * *